United States Patent [19]

Schmidt et al.

[11] 4,300,915

[45] Nov. 17, 1981

[54] PROCESS FOR THE PYROLYSIS OF REFUSE

[75] Inventors: Rudiger Schmidt; Franz Steininger; Klaus Hillekamp, all of Munich, Fed. Rep. of Germany

[73] Assignee: Babcock Krauss-Maffei, Munich, Fed. Rep. of Germany

[21] Appl. No.: 136,900

[22] Filed: Apr. 3, 1980

Related U.S. Application Data

[63] Continuation-in-part of Ser. No. 57,263, Jul. 13, 1979, abandoned, which is a continuation-in-part of Ser. No. 957,989, Nov. 16, 1978, abandoned.

[30] Foreign Application Priority Data

Nov. 15, 1977 [DE] Fed. Rep. of Germany ..... 2751007
Jun. 9, 1978 [DE] Fed. Rep. of Germany ..... 2825429

[51] Int. Cl.[3] ..... C10J 3/00

[52] U.S. Cl. ..... 48/197 R; 48/197 A; 48/209; 55/73; 201/2.5

[58] Field of Search ..... 48/197 R, 197 A, 209; 252/373, 421; 423/449, 454, 458; 201/2.5, 25; 55/73

[56] References Cited

U.S. PATENT DOCUMENTS

| | | | |
|---|---|---|---|
| 2,767,233 | 10/1956 | Mullen | 48/213 |
| 3,376,111 | 4/1968 | Stegelman | 423/458 |
| 3,639,111 | 2/1972 | Brink et al. | 48/209 |
| 3,866,411 | 2/1975 | Marion et al. | 252/373 |
| 4,028,068 | 6/1977 | Kiener | 48/209 |

*Primary Examiner*—Peter F. Kratz
*Attorney, Agent, or Firm*—Learman & McCulloch

[57] ABSTRACT

A process for the pyrolysis of refuse of all kinds wherein the refuse is subjected to carbonization to produce solid residues and raw carbonization gases, the residues and gases are separated, the gases are divided into two parts, one part of the gases is completely burned to produce hot flue gases, the flue gases are mixed with the second part of the raw carbonization gases, the mixture of gases is cracked in a reactor, and the cracked gases are cooled.

8 Claims, 2 Drawing Figures

PROCESS FOR THE PYROLYSIS OF REFUSE

RELATED APPLICATIONS

This application is a continuation-in-part of application Ser. No. 57,263, filed July 13, 1979, which, in turn, is a continuation-in-part of application Ser. No. 957,989, filed Nov. 16, 1978 both abandoned.

BACKGROUND OF THE INVENTION

In one known process for the pyrolysis of refuse (U.S. Pat. No. 4,028,068) the high temperature treatment of the low temperature carbonisation gases is carried out by drawing the low temperature carbonisation gases under suction through a reaction zone formed by red hot coke and, optionally, other carbon carriers. The object of this is to convert and split up the moisture present in the low temperature carbonisation gases into high grade fuel gases (water gas reaction).

A serious disadvantage of this known process lies in the considerable danger of sintering of the carbon bed used in the high temperature zone (with all the operational disadvantages which this involves). In order as far as possible to counteract this danger, it is necessary in the known process to use mainly low ash coal if the cracking temperature is to be selected at a sufficiently high level. This considerably increases the operating costs. In order to be able to achieve a cracking temperature of around 1100° C., for example, it is necessary to use a coal having an ash content of no higher than 3 to 4% by weight. If the coal used has a higher ash content, the cracking temperature has to be reduced to avoid the danger of sintering. However, this seriously affects the result of cracking.

The object of the present invention is to provide a process for the pyrolysis of refuse of all kinds, which does not have any of the disadvantages of conventional processes, and which is distinguished by its simple, trouble-free operation, giving a pyrolysis gas having a minimal content of organic pollutants and a high calorific value.

SUMMARY OF THE INVENTION

According to the invention this object is achieved by a pyrolysis process wherein the refuse is subjected to carbonisation in a rotary kiln having a wall temperature of between about 400°–600° C. in the substantial absence of air to produce solid residues and raw carbonisation gases at a temperature of between about 300°–450° C. and at a calorific value of between about 1000–3500 kcal/standard cubic meter (moist), following which the residues and raw gases are separated. The separated gases are divided into a first part comprising between about one-fifth and one-half of the total and a second part comprising between about one-half and four-fifths of the total. The first part of the raw carbonisation gases is burned to produce hot flue gases with a solid carbon content of less than 50 mg/standard cubic meter, and such flue gases then are mixed with the second part of the raw carbonisation gases to obtain a cracking temperature of between about 900° and 1100° C. The mixture of gases then is fed through a free-flow, non-catalytic reactor at a pressure of between about 0.7 and 1.2 atm, a velocity of between 1 and 30 meters per second, and a residence time of between 0.5 and 3 seconds to crack the long chain organic constituents in such mixture of gases. The cracked gases then are cooled to a temperature just above their dew point and at a rate of at least 125° C. per second.

In the practice of the process according to the invention, the cracking temperature selected is such that, for a predetermined residence time, the content of condensable organic compounds from the cracked gases is less than 0.2 g/standard cubic meter, and the division of the raw carbonisation gases selected is such that, for a predetermined calorific value of such raw carbonisation gases, the selected cracking temperature is obtained.

The preferred pyrolysis process according to the invention may be summarized further as follows:

(a) refuse is subjected to carbonisation in a rotary kiln at a kiln wall temperature of between 400° and 600° C. in the substantial absence of air to produce
  raw carbonisation gases at a temperature of between 300° and 450° C. and at a calorific value of between 1000 and 3500 kcal/standard cubic meter (moist) and
  solid residues, (b) separating said raw carbonisation gases from said solid residues, (c) dividing said raw carbonisation gases into a first part comprising between 1/5 and ½ of the total amount and a second part comprising between ½ and 4/5 of the total amount of said raw carbonisation gases, (d) completely burning said first part of the raw carbonisation gases to produce hot flue gases with a solid carbon content of less than 50 mg/standard cubic meter, (e) mixing said hot flue gases with said second part of the raw carbonisation gases to obtain a cracking temperature of between 900° and 1100° C., (f) feeding said mixture of gases through a free-flow non-catalytic reactor at a pressure of between 0.7 and 1.2 at, a velocity of between 1 and 30 meter per second and a residence time of between 0.5 and 3 seconds to crack the long chain organic constituents in said mixture of gases, (g) selecting the cracking temperature so that for a predetermined residence time the content of condensable organic compounds in the cracked gases is less than 0.2 g/standard cubic meter, (h) selecting the division of said raw carbonisation gases so that for a predetermined calorific value of said raw carbonisation gases said selected cracking temperature is obtained, and (i) cooling said cracked gases to a temperature just above their dew point at a rate of at least 125° C. per second.

By virtue of the fact that the use of a carbon bed for high temperature treatment of the low temperature carbonisation gases is avoided in the process according to the invention, all the disadvantages associated with the possible sintering of a carbon bed are obviated. Accordingly, the cracking temperature may be freely selected and may be adjusted in such a way that the objective of cracking is optimally achieved.

In extensive tests of the invention it was surprisingly found that cracking of the long-chain organic constituents present in the raw carbonisation gases can be carried out simply and effectively by features c–h above. Features c–e provide a minimum solid content in the hot flue gases and in the cracked gases. In this way the dropping of solid carbon in the reactor and cleaning problems induced thereby are avoided completely. Furthermore, the calorific value of the cracked gases is increased.

There is an inverse relationship between the cracking temperature and the content of condensable organic compounds in the cracked gases. The higher the cracking temperature (with a given residence time), the lower the content of condensable organic compounds in the cracked gases.

According to feature g above, the cracking temperature is selected so that, for a given residence time (predetermined by the dimensions of the reactor and the available amount of raw carbonisation gases per unit of time), the content of condensable organic compounds in the cracked gases is less than 0.2 g/standard cubic meter. For this necessary cracking temperature to be obtained, the great differences of calorific value of all kinds of refuse have to be taken into account. The lower the calorific value of the carbonised refuse, the greater must be the first part of the raw carbonisation gases (i.e., the part to be burned completely) in order to obtain the desired cracking temperature when mixing the hot flue gases with the second part of the raw carbonisation gases. To obtain complete burning of the first part of the raw carbonisation gases, combustion air (preferably preheated) is supplied in an approximately stoichiometric amount. To obtain a minimum content of solid carbon in the cracked gases, it is important to avoid any substantial combustion in the cracking reactor. The flue gases, therefore, should not contain a substantial amount of oxygen.

The cracking process is also accompanied by the formation of radicals which tend to attach themselves to unsaturated hydrocarbons, resulting in the formation of long-chain hydrocarbons after a certain time. In order to counteract this danger, it is best to "freeze" the condition produced by the cracking process as quickly as possible by cooling. In this way, the radicals react with the hydrogen available to form methane. In the process according to the invention, therefore, the cracked gases are rapidly cooled on leaving the reactor, the rate at which they are cooled amounting to at least 125° C. per second and preferably to between 200° and 500° C. per second.

According to the invention, it is best to use a tubular reactor of which the wall consists of at least 60%, preferably 60 to 80%, of silicon carbide and at most 40%, preferably 10 to 30%, of aluminum oxide. This material has the necessary wear resistance and corrosion resistance to withstand the eroding and corroding influence of the raw carbonisation gases, the hot flue gases, and the resulting cracked gases. The relatively low content of aluminum oxide ($al_2O_3$) is explained by the fact that, at high temperature, aluminum oxide catalytically promotes the formation of hydrocyanic acid from methane and ammonia (both compounds being present in the raw carbonisation gases).

The density of the silicon carbide/aluminum oxide bricks used for the wall of the reactor best amounts to between 1.7 and 2.1 kg/l and preferably to between 1.8 and 2.0 kg/l.

The low temperature carbonisation of the refuse in the rotary kiln best takes place at an outside wall temperature in the range from about 400°–600° C. resulting in raw carbonisation gases at a temperature of between about 300°–450° C. and a calorific value of between about 1000–3500 kcal/standard cubic meter (moist).

In one preferred embodiment of the invention, the raw carbonisation gases are freed from dust in a cyclone before entering the reactor. This step, although not essential in the process according to the invention, is useful in order to increase the endurance of the reactor.

Before wet cleaning or any other form of after-treatment of the cooled cracked gases, solids such as carbon black and substances bound thereto by adsorption can be separated.

The carbon black, which consists of pure carbon and hydrogen-depleted long chain hydrocarbons, enters into an adsorptive bond with the inorganic pollutants, such as HCl, $NH_3$, $H_2S$, and the organic pollutants, such as HCN, phenols, tar, oils, the adsorptive bond thus formed being stronger, the lower the adsorption temperature.

In order to obtain as strong as possible an adsorptive bond between the pollutants present in the cracked gases and the carbon black, the gas is cooled before separation of the carbon black to a temperature just above the dew point of the cracked gases. On the one hand, this prevents the pollutants passing into solution; on the other hand, adsorption capacity is at its greatest at this low temperature. The dew point of the gas is determined by the composition of the gas and may therefore vary in the event of fluctuations in the composition of the waste products introduced. In general, the minimum adsorption temperature is between 160° and 180° C. The maximum adsorption temperature is limited by the weakening adsorptive bond between pollutants and the carbon black. In general, it is not advisable to separate the carbon black from the gas stream at temperatures above 450° C.

According to the invention it may be advantageous to introduce into the cooled cracked gases, prior to the above mentioned separating step, fine-grained carbon as an adsorbant and/or acid or basic absorbants. The carbon black and/or any additionally introduced adsorbants or absorbants may be separated from the cracked gases, for example in cyclones, electrofilters, filter cloths, solids filters, etc. This preliminary cleaning of the cracked gases considerably eases the burden on any following wet cleaning operation which may therefore be carried out considerably more economically. Following separation of the carbon black and before washing, the cracked gases may with advantage be cleaned by absorption. In a first cleaning stage, the gases are best passed through an acid absorber, for example aluminum oxide, in which the residues of organic pollutants and the basic constituents of the inorganic pollutants are removed. In a second stage, the gases are passed over a basic absorber, for example calcium oxide, magnesium oxide, iron oxide, etc., to bind the acid components of the pollutants, such as HCl, HCN, $H_2S$. During the passage of the cracked gases through the absorber, it is again important to assure that the temperature of the gases does not fall below their dew point. Accordingly, it is best directly to deliver the gases to the absorber following separation of the carbon black. In some cases, intermediate heating may be necessary.

DESCRIPTION OF THE DRAWINGS

The invention is described in more detail in the following with reference to the accompanying drawings, in which.

DETAILED DESCRIPTION

Figure 1:
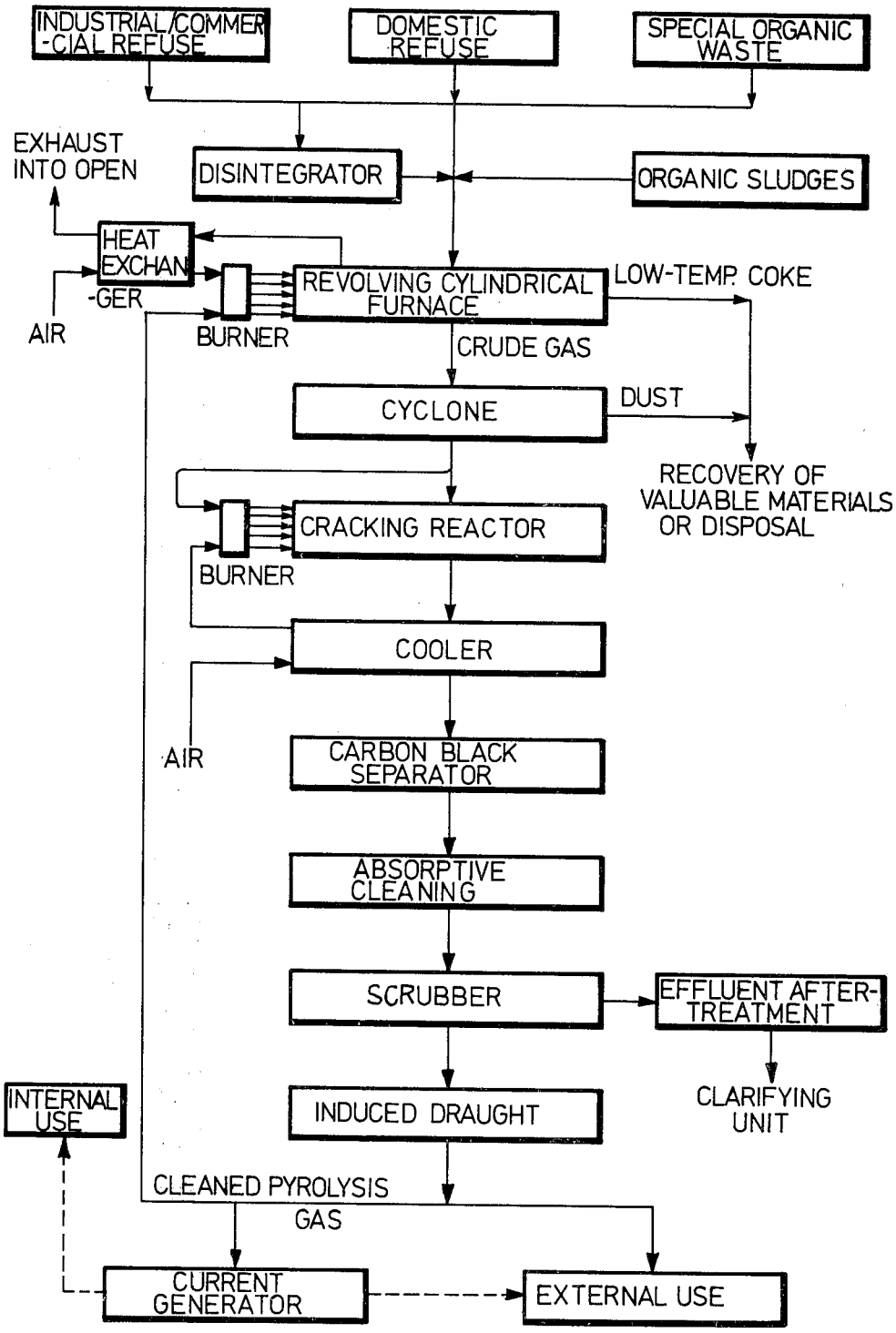
FIG. 1 comprises a flow chart of a pilot pyrolysis plant with a throughput of approximately 500 kg. of refuse per hour.
Figure 2:
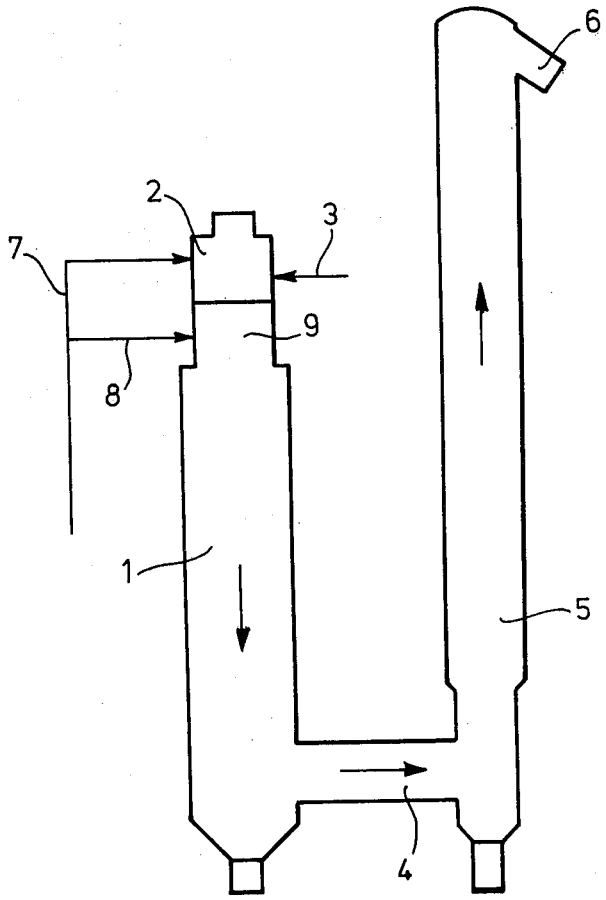
FIG. 2 is a diagrammatic illustration of the reactor and a cooler forming parts of apparatus useful in the process.

The refuse (industrial refuse, domestic refuse and/or special organic refuse) is size-reduced in a disintegrator to about the size of the palm of a hand and subsequently introduced, together with organic sludges, into a known, indirectly heated rotary kiln (length 9 meters, diameter 0.8 meter) through a gas-tight lock system. This rotary kiln may be fired by natural gas and/or low temperature raw carbonisation gas. In the warm-up phase, the rotary kiln is fired by natural gas; once sufficient raw carbonisation gas has been produced, the kiln is switched over to heating by raw carbonisation gas. The rotary kiln is divided into six zones to be heated independently of one another, so that it is possible to meet the various heat demands in the individual zones. The residence time of the material to be subjected to low temperature carbonisation in the rotary kiln furnace may be varied over a wide range in dependence upon the rotational speed and/or the inclination of the kiln.

In the pyrolysis of domestic refuse, it it preferred that the outside wall temperature in the first stage of the kiln be maintained between 400° C. and 600° C. and that the residence time in the kiln be maintained between 30 and 50 minutes. This will produce 0.3 to 1.0 standard cubic meter (moist) raw carbonisation gases per kilogram of refuse at a temperature between 300°–450° C. and a calorific value between 1000–3500 kcal/standard cubic meter. After the cracking, this will provide approximately 0.6 to 2.0 standard cubic meter (dry) with a calorific value between 1000–1400 kcal/standard cubic meter. The content of condensable organic compounds in the raw carbonisation gases is between 20 and 50 g/standard cubic meter. After the cracking the content of condensable organic compounds in the cracked gases is between 20 and 80 mg/standard cubic meter.

The raw carbonisation gas supplied by the rotary kiln is initially freed from dust in a cyclone and then is divided into two parts before entering a cracking reactor 1. This free-flow, non-catalytic cracking reactor is tubular in construction (height 6.6 m, external diameter 1000 mm, internal diameter 470 mm). The upper end of this tubular reactor comprises a combustion chamber 2 provided with preheated air or oxygen from a supply 3. The first part of the raw carbonisation gases is supplied via line 7 to the combustion chamber 2 and is completely burned to form hot flue gases which are mixed with the second part of the raw carbonisation gases in a mixing zone 9, the latter gases being delivered to the zone 9 via a line 8. The mixture and cracking temperature is between 900°–1100° C.

The cracking reactor 1 includes at its lower end a relatively short, horizontal connecting pipe 4 (2.5 meters long, 0.25 meter in diameter) which communicates with the lower end of a cooler 5. The cooler 5 has an outlet 6 which, if desired, may communicate with a second, similar cooler, not shown.

From the cooler (or coolers) the cracked gases then enter a carbon black separator in which carbon black and adsorptively bound inorganic pollutants are removed. The gases then undergo absorptive cleaning before being subjected to wet cleaning in a scrubber. The waste water which accumulates is delivered to a clarifying unit. The cleaned gases leave the scrubber with a temperature of around 80° C.

The induced draught maintains the pressure gradient in the gas cleaning stream and feeds about 25–50% of the cleaned cracked gases to the rotary kiln (the stated percentage relates to refuse of a mean calorific value of 1800 kcal/kg, the percentage necessary to cover the carbonisation energy requirements in the rotary kiln depends upon the calorific value of the refuse). For the rest, the cleaned cracked gases are delivered to a current generator or are put to some other external use.

The mixture of the second part of the raw carbonisation gases and the hot flue gases is cracked during its passage through the free-flow, non-catalytic (empty) reactor 1 at a pressure of between about 0.7 and 1.2 atm. The speed of gases in the reactor part 1 is maintained between 2 and 5 m/s and in the horizontal connecting pipe between 4 and 10 m/s. Due to this high speed, the very low solid carbon content of the flue gases, the avoidance of any combustion in the cracking part of the reactor, and since the reactor is a hollow tube, no carbon black or other solid carbon will be deposited in the reactor. The cracked gases are cooled in the cooler 5 to about 600° C. at a rate of at least 125° C. per second. If a second cooler is utilized, the gases are cooled to about 250° C.

The following five examples show the pyrolysis of different kinds of refuse resulting in different ratios of dividing the raw carbonisation gases, different cracking temperatures, different residence times, etc.

EXAMPLES

| | | No. 1 | No. 2 | No. 3 | No. 4 | No. 5 |
|---|---|---|---|---|---|---|
| Refuse, calorific value | [kcal/kg] | 1000 | 1000 | 1800 | 1800 | 3000 |
| Carbonisation | | | | | | |
| Temperature of kiln outside wall | [°C.] | 550 | 550 | 550 | 550 | 550 |
| Raw carbonisation gases | | | | | | |
| Temperature | [°C.] | 400 | 400 | 400 | 400 | 400 |
| Quantity (moist) | [$Nm^3$/kg] | 0.85 | 0.85 | 0.84 | 1.26 | 0.95 |
| Quantity (dry) | [$Nm^3$/kg] | 0.41 | 0.41 | 0.53 | 0.79 | 0.85 |
| Calorific value (moist) | [kcal/$Nm^3$] | 1006 | 1006 | 1891 | 1891 | 3240 |
| Calorific value (dry) | [kcal/$Nm^3$] | 1862 | 1862 | 2390 | 2390 | 3621 |
| Content of condensable organic compounds | [g/$Nm^3$] | 20 | 20 | 30 | 30 | 50 |
| Combustion of part of raw carbonisation gases | | | | | | |
| Percentage first part/total quantity of raw carb. gases | [%] | 50 | 40 | 33 | 40 | 25 |
| Quantity of first part | [$Nm^3$/kg] | 0.43 | 0.34 | 0.28 | 0.50 | 0.24 |
| Content of solid carbon in flue gas | [mg/$Nm^3$] | 5 | 3 | 9 | 14 | 19 |
| Theoretic temperature of flue gas ($\lambda = 1$) | [°C.] | 1450 | 1580 | 1880 | 1880 | 1960 |
| Cracking of raw carbonisation gases | | | | | | |
| Cracking temperature (temperature obtained by mixing flue gas with second | | | | | | |

EXAMPLES-continued

| | | No. 1 | No. 2 | No. 3 | No. 4 | No. 5 |
|---|---|---|---|---|---|---|
| part of raw carbonisation gases, taking into consideration reaction enthalpy and radiation loss) | [°C.] | 930 | 965 | 1010 | 1120 | 1080 |
| Residence time | [s] | 2 | 2.2 | 2.1 | 1.4 | 1.8 |
| Velocity of flow of gases through reactor | [m/s] | 4 | 4 | 4 | 6 | 4 |
| Quantity of cracked gases (dry) | [$Nm^3$/kg] | 0.65 | 0.68 | 0.86 | 1.6 | 1.5 |
| Content of solid carbon in cracked gases | [mg/$Nm^3$] | 35 | 72 | 60 | 82 | 80 |
| Content of condensable organic compounds in cracked gases | [mg/$Nm^3$] | 50 | 40 | 65 | 78 | 71 |
| Calorific value of cracked gases | [kcal/$Nm^3$] | 1017 | 1065 | 1270 | 1188 | 1360 |

Legends:
$Nm^3$ = standard cubic meter
$\lambda$ = relation between amount of supplied combustion air and amount necessary for stoichiometric combustion In the context of the invention, the expression "refuse" is understood to cover any organic waste, such as domestic refuse, industrial and commercial refuse, special refuse, tank residues, oil sludges, oil-polluted soil, plastics, tyres, etc., and also residues from textile and cellulose factories.

We claim:

1. A process for the pyrolysis of refuse comprising:

(a) subjecting the refuse to carbonisation in a rotary kiln in the substantial absence of air to produce raw carbonisation gases at a temperature of between about 300° and 450° C. and at a calorific value of between 1000 and 3500 kcal/standard cubic meter (moist), and solid residues;

(b) separating said raw carbonisation gases from said solid residues;

(c) dividing said raw carbonisation gases into a first part comprising between about one-fifth and one-half of the total amount and a second part comprising between about one-half and four-fifths of the total amount of said raw carbonisation gases;

(d) completely burning said first part of the raw carbonisation gases to produce hot flue gases with a solid carbon content of less than 50 mg/standard cubic meter;

(e) mixing said hot flue gases with said second part of the raw carbonisation gases to obtain a cracking temperature of between about 900° and 1100° C.;

(f) feeding said mixture of gases through a free-flow, non-catalytic reactor at a pressure of between about 0.7 and 1.2 atm, a velocity of between about 1 and 30 meters per second, and a residence time of between about 0.5 and 3 seconds to crack the long chain organic constituents in said mixture of gases, (g) the cracking temperature being so selected that for a predetermined residence time the content of condensable organic compounds in the cracked gases is less than 0.2 g/standard cubic meter, (h) the division of said raw carbonisation gases being so selected that for a predetermined calorific value of said raw carbonisation gases said selected cracking temperature is obtained; and (i) cooling said cracked gases to a temperature just above their dew point at a rate of at least 125° C. per second.

2. A process according to claim 1 including feeding said mixture of gases through said reactor at a residence time of between 1.2 and 2.5 seconds.

3. A process according to claim 1 including separating dust from said raw carbonisation gases prior to dividing them into two parts.

4. A process according to claim 1 including cooling the cracked gases at a rate of from 200° C. to 500° C. per second.

5. A process according to claim 1 including separating from the cooled cracked gases solids carbon black and substances bound thereto by adsorption.

6. A process according to claim 5 including introducing into the cooled cracked gases prior to the separating step fine-grained carbon as an adsorbant and/or acid or basic absorbants.

7. A process according to claim 1 wherein the reactor in which said cracking treatment is performed has walls composed of between 60% and 80% silicon carbide and not more than 40% aluminum oxide.

8. A process according to claim 7 wherein said walls are composed of silicon carbide/aluminum oxide bricks having a density of between 1.7 and 2.1 kg/l.

* * * * *